United States Patent [19]

Lussi et al.

[11] Patent Number: 5,015,516

[45] Date of Patent: May 14, 1991

[54] DECORATIVE INLAID TYPES OF SHEET MATERIALS

[75] Inventors: Edward F. Lussi, Bethelem; Thomas G. Smith, Easton, both of Pa.

[73] Assignee: Tarkett Inc., Whitehall, Pa.

[21] Appl. No.: 333,763

[22] Filed: Apr. 3, 1989

Related U.S. Application Data

[63] Continuation of Ser. No. 773,984, Sep. 9, 1985, abandoned.

[51] Int. Cl.[5] ..... B23B 5/22

[52] U.S. Cl. ..... 428/143; 428/141; 428/142; 428/158; 428/159; 428/195; 428/203; 428/204; 428/207; 428/147; 428/327

[58] Field of Search ..... 428/195, 198, 204, 207, 428/323, 327, 156, 158, 159, 141–143, 147, 203, 318.4, 319.3, 319.7, 908.8

[56] References Cited

U.S. PATENT DOCUMENTS

| | | | |
|---|---|---|---|
| 3,856,900 | 12/1974 | Erb | 264/9 |
| 4,126,727 | 11/1978 | Kaminski | 428/172 |
| 4,196,243 | 4/1980 | Sachs et al. | 428/147 |
| 4,212,691 | 7/1980 | Potosky et al. | 428/147 |
| 4,239,797 | 12/1980 | Sachs | 428/327 |
| 4,456,643 | 6/1984 | Colyer | 428/156 |

FOREIGN PATENT DOCUMENTS

| | | | |
|---|---|---|---|
| 85784 | 8/1983 | European Pat. Off. | 428/204 |

OTHER PUBLICATIONS

Sales Brochure Entitled "SMARAGD" prepared by FORBO, P.O. Box 172, S-40122 Gothenburg, Sweden (No Date or Author, 6 Pages).

Patent Cooperation Treaty International Search Report International Application No.: PCT/US86/01849.

*Primary Examiner*—Pamela R. Schwartz

*Attorney, Agent, or Firm*—Brooks Haidt Haffner & Delahunty

[57] ABSTRACT

The invention provides decorative, inlaid sheet materials which incorporate a matrix layer of discreet, low aspect ratio resinous particles embedded in a resinous coating. The use of printed patterns which are visible beneath the adhesive matrix containing the particles constitutes a preferred embodiment of the invention. The sheet materials of this invention are real through-patterned inlaids which no not lose their pattern due to wear in use, and which offer unique design advantages and flexibility, as well as superior properties.

29 Claims, No Drawings

DECORATIVE INLAID TYPES OF SHEET MATERIALS

This application is a continuation of application Ser. No. 773,984, filed Sept. 9, 1985, now abandoned.

FIELD OF THE INVENTION

The present invention relates to decorative inlaid sheet materials and the like. More particularly the invention is concerned with the use of polyvinyl chloride (hereinafter "PVC" ) polymerization agglomerates as decorative particles and their application on floor and wall covering substrates to produce realistic inlaid patterns, utilizing heretofore unobtainable design strategies and exhibiting superior properties.

The particles can be spherical and, when such is the case, are hereinafter sometimes referred to as "pearls". These pearls can be random-sifted on the substrate or applied in geometrical patterns. Also disclosed is the use of mixes or blends containing transparent or partly transparent pearls allowing visible underprinting as a further strategy for unique design variations.

BACKGROUND OF THE INVENTION

Sheet materials, in particular sheet vinyl flooring products, made with chips or particulate material, are commonly referred to as inlaids. These products and processes for their manufacture are well known in the floorcovering business and originate back to the early linoleum times where through patterned floorcoverings, based on linseed oil, cork dust and resins were developed by the industry. The process was later modified for vinyl.

Vinyl inlaid floorcovering consists of coarse colored particles, such as chips or dry blends, which are "laid on" a substrate and then sintered by heat, or "laid in" a transparent liquid or solid matrix and fused by heat. The chips are produced from pre-gelled or fused spread, calendered or extruded compounds cut into geometrically regular profiles or ground into randomly shaped particles.

The dry blends are made by mixing fine PVC powder with plasticizer, filler and color pigments and heating above the PVC compound's softening temperature. The small original particles "grow" and form a loose, porous, coarse, fluffy mass.

Currently, to produce realistic inlaid patterns for sheet vinyl, conventional manufacturing procedures distribute the coarse particles on the substrate in different steps with the help of area-complementary stencils, followed by topcoating with a clear wearlayer. This method is complicated and can only be used to produce large geometric patterns.

The inlaid floorcoverings are normally characterized as those which maintain their decorative appearance as the surface is worn or abraded away. This characteristic makes such products particularly suitable for use in commercial areas where significant wear is encountered.

Modern inlaids generally fall into two classifications: resilients and non-resilients. Resilients include a substantially continuous layer of foam and are usually made by incorporating solid particulate material into a plastisol coating, followed by gelling and fusing. Non-resilients do not contain a foam layer and usually are made by sintering and/or calendering, or otherwise compacting, particulate material.

The non-resilient products commercially offered are those containing large (about ⅛ inch) square chips in a clear matrix and those containing small (about 0.004 inch) dry blend resin particles made by sintering and/or compacting normal dry blend resins. It is believed that the reason no products containing chips, granules, or particles of an intermediate particle size (e.g. ranging from about 0.004 inch to about 0.04 inch) are offered results from limitations inherent in current inlaid manufacturing technology, discussed more fully hereinafter.

While construction of inlaid products by compaction from discreet chips or particles (normally of different colors) offers distinct styling opportunities, a significant premium is paid in terms of expensive, cumbersome equipment. Furthermore, the nature of the process restricts the range of designs available. For example, in order to effect specific registered pattern definition, it is necessary to deposit chips of different colors in preselected areas on the sheet. This is difficult mechanically, and results in a slow cumbersome process which does not produce finely defined designs.

Some of the inherent difficulties in current production techniques for non-resilient inlaids have been minimized by use of increasingly sophisticated materials and design techniques, such as using fine particle size, dry blend resins, printing over the surface of the resulting inlaid product, optionally, embossing, with and without application of a wearlayer. Unfortunately, whereas the use of the finer particle size preserves the specific characteristic of an inlaid product, i.e. the pattern does not change as the product wears through, overprinting the product, whether or not a wear layer is applied, essentially negates this characteristic because wearing through the print layer essentially destroys the pattern. This eliminates the product from commercial, high-use environments and limits its utility principally to styling effect in residential and related applications.

Resilient inlaids are usually made by embedding ground plastic particulate material in a plastisol coating. U.S. Pat. No. 4,212,691 exemplifies such products and methods for their manufacture. As taught in this patent, the thickness of the particles of the decorative chips or flakes is stated to be from about 3 mils to about 25 mils (e.g. see column 7, lines 62–64). However, it is the length of the particle, i.e. its largest dimension, rather than thickness that is observed when viewing the pattern. That dimension is stated to be from about 50 to 500 mils at column 8, lines 17–18. It is to be noted that the products disclosed all contain embedded chips or flakes ground from plastic sheet stock, even when chips or flakes from other stock materials are added (e.g. see column 8, lines 4 et seq). These chips or flakes characteristically have a high aspect ratio (i.e. length/thickness).

Thus, existing inlaid technology, although capable of producing commercially satisfactory inlaid products, has limitations and deficiencies. State of the art inlaid technology for "chip" products first grinds the chips from plastic sheets. This predefines the particle shape and is expensive. Furthermore, spherical particle shapes can not be made by the grinding techniques currently in use for inlaids.

Additionally, products formed by compacting or sintering dry blends have always shown limited particle distinction due to process limitations and available particle sizes. The particles tend to lose their identity due to agglomeration or lumping caused by the sintering process.

PURPOSES AND OBJECTS OF THE INVENTION

It is, therefore, a principal purpose and object of this invention to provide heretofore unobtainable real through patterned inlaids, offering unique design advantages and flexibility, as well as superior properties. For example, wear resistance is significantly increased in comparison with leading commercially available inlaids. It is also a primary purpose and object of this invention to provide a novel process for producing such inlaids which is believed to be simpler and significantly less complicated than state-of-the-art inlaid production technology. Another purpose and object is to provide a process that in the main utilizes today's plastisol equipment and technology. Other principal purposes and objects of this invention will be apparent from the following discussion.

SUMMARY OF THE INVENTION

The foregoing and other purposes and objects of this invention are accomplished by providing a decorative, inlaid floor or wall covering product which incorporates as the essential elements thereof (i) resinous particles having an aspect ratio significantly lower than those currently employed in inlaids commercially offered in the United States and a particle size, preferably falling within the range of from about 0.004 inch to about 0.040 inch, (ii) an adhesive matrix in which said particles are embedded, and (iii) a substrate which supports these and any other optional elements of the product, such as a substrate coating or sealant, a print layer, and a wear layer. Such optional elements will be discussed more fully hereinafter.

In general the particles employed in this invention have an aspect ratio of no greater than about 2:1 and, preferably, no greater than about 1.5:1. Particles having an aspect ratio of about 1:1 and, in particular, spheroidal particles, are especially preferred because of the excellent results achieved therewith, as discussed more fully hereinafter. The use of particles which are essentially as thick as they are flat, i.e. having a low aspect ratio, provides a product that will not lose its pattern due to wear in use, thus preserving the unique property which characterizes true inlaids.

The use of printed patterns which are visible beneath the adhesive matrix containing the particles broadens the options available to the pattern designer and constitutes another embodiment of this invention. Exemplary is a decorative, inlaid floor or wall covering which comprises:

(a) a substrate, (b) a printed layer, generally comprising a printable substrate coating or sealant, onto which is printed a pattern in an ink suitable for floor or wall covering applications, applied over and in contact with said substrate, and (c) an adhesive matrix, overlaying said printed layer, and in contact therewith, in which are embedded the resinous particles, said matrix being sufficiently transparent or transluscent to permit the underprint to show through.

Such product provides options for a wide variety of design strategies heretofore unobtainable with state-of-the-art sheet vinyl technology and constitutes a preferred embodiment of this invention.

The inlaid products of this invention offer unique design advantages. Further, cost advantages can also be realized by utilizing raw materials which are believed to be unique to inlaid manufacture. For example, certain of the novel products of the invention incorporate an adhesive matrix consisting essentially of a plastisol layer containing a high loading of transparent and/or transluscent and colored, spheroidal resinous particles, which, preferably, range in size from about 0.004 inches to about 0.040 inches. When this matrix is applied over a printed pattern, a unique visual effect is produced.

Such particles can be made in uniform controlled sizes by employing technology described in U.S. Pat. No. 3,856,900, the entire contents of which are incorporated herein by reference. Alternatively, special large particle size dry blend resinous particles, either screened to the desired size ranges of this invention from oversized material obtained from normal production variations, or specially made particles in the desired size range, can be utilized.

Another, and preferred, embodiment of this invention is a decorative, inlaid floor covering which comprises:

(a) a non-asbestos felt sheet substrate, (b) a gelled, printable, plastisol coating over said substrate, (c) one or more solvent based PVC-polyvinyl acetate copolymer inks applied to the surface of the plastisol layer, (d) a gelled adhesive matrix, overlaying said plastisol/-print layer, and in contact therewith, containing an effective amount of a homopolymer or a copolymer of vinyl chloride, in which are embedded discreet spherical and essentially spherical, gelled and resinous particles, at least some of which permit the underprint to show through, and wherein said particles are coarse PVC homopolymer or copolymer polymerization agglomerates, sized to between about 0.004–0.060 (preferably less than 0.040) inches, and, optionally, (e) a fused, transparent, plastisol wearlayer as a top coat.

GENERAL DESCRIPTION OF THE INVENTION

The product is comprised of a base supporting material, which, optionally, may be precoated with a plastisol to enhance printability, a print layer offering decoration, and an adhesive matrix containing transparent or translucent and/or pigmented resin particles, which are preferably spherical or spheroidal. In one embodiment the resulting product has an additional coating on its top surface to enhance surface properties, such as gloss and the like, and insure there is no residual porosity resulting from the process of embedding the particulates in the adhesive matrix.

The incorporation of particulate materials of such size and shape, and at the loadings herein described provides the retention of pattern as the product wears through characteristic of inlaid products. The incorporation of transparent particles allowing the underprint to show through, provides an additional dimension in design capability. The combination of a transparent or transluscent adhesive matrix loaded with transparent or transluscent and/or pigmented or colored particulate material and the use of rotogravure or other forms of print offering fine registered detail and definition, provide a product which is believed to be unique and a significant advance in the art.

One of the advantages of this invention is that it employs ingredients and processing technology well known to those skilled in the art. Also, by employing a fluid plastisol as the matrix material binding the particles together, the product can be manufactured without the need for the high pressures or temperatures characteristic of the calendering or agglomeration steps of the prior art processes. This processing characteristic also distinguishes the subject process from those of the prior art which employ only dry blend resins, which are agglomerated through heat sintering.

Substrate

The substrate is a relatively flat fibrous or non-fibrous backing sheet material, such as a fibrous, felted or matted, relatively flat sheet of overlapping, intersecting fibers, usually of non-asbestos origin. The substrate can, if desired, be asbestos or non-asbestos felts or papers, woven or non-woven; knitted or otherwise fabricated textile material or fabrics comprised of cellulose, glass, natural or synthetic organic fibers, or natural or synthetic inorganic fibers, or supported or non-supported webs or sheets made therefrom or filled or unfilled thermoplastic or thermoset polymeric materials. These and other substrate or base materials are well known in the art and need not be further detailed here.

Substrate Coating

The substrate or base material, optionally, can be coated to improve the print quality of the substrate. Such coatings can be plastisols, organosols, lacquers, filled or unfilled latex coatings, or other coatings conventionally employed as preprint sealants in the manufacture of floor or wall covering products.

As used herein, the term "plastisol" is intended to cover a relatively high molecular weight polyvinyl chloride resin dispersed in one or more plasticizers. The plastisol upon heating or curing forms a tough plasticized solid. For purposes of the present invention plastisol compositions are intended to include organosols, which are similar dispersed polyvinyl chloride resin materials that, in addition, contain one or more volatile liquids that are driven off upon heating.

Those skilled in the art will appreciate that, in addition to the basic resin constituents, other commonly employed constituents can be present in the plastisol compositions in minor proportions. Such other constituents commonly include heat and light stabilizers, viscosity depressants, and/or pigments or dyes, the latter in order to contribute color to the polyvinyl chloride resin.

Typically the substrate coating employed in the products of this invention is a resinous polymer composition, preferably, a polyvinyl chloride plastisol which is substantially uniformly applied to the substrate surface, for example by means of a conventional reverse roll coater or wire wound bar, e.g. a Meyer Rod Coater, wherein the grooves provided by the wires assist in metering the flow of the plastisol. The particular means for applying the substrate coating to the surface of the substrate does not relate to the essence of the invention and any suitable coating means can be employed. Exemplary of other coating means are knife-over roll coater, rotary screen, direct roll coater and the like.

The thickness of the resinous polymer composition or plastisol, as it is applied to the surface of the substrate, is substantially uniform, and is in the range of about 3 mils to about 30 mils. The substrate can be thinner or thicker as may be required by the particular product application.

Although the preferred and typical substrate coating is a polyvinyl chloride homopolymer resin, other vinyl chloride resins can be employed. Exemplary are a vinyl chloride-vinyl acetate copolymer, a vinyl chloride-vinylidene chloride copolymer, and copolymers of vinyl chloride with other vinyl esters, such as, vinyl butyrate, vinyl propionate, and alkyl substituted vinyl esters, wherein the alkyl moiety preferably is lower alkyl containing between about 1–4 carbons. Other suitable synethetic resins such as polystyrene, substituted polystyrene, preferably wherein the substituents are selected from the group consisting of alkyl ($C_1$–$C_{10}$, preferably $C_1$–$C_4$), aryl (preferably, $C_6$–$C_{14}$), polyolefins such as polyethylene and polypropylene, acrylates and methacrylates, polyamides, polyesters, and any other natural or synethetic resin capable of being applied to the substrate or base coatings of this invention to provide a smooth and uniform surface and/or to improve the print quality of the substrate or base coating surface, are also applicable; provided such resin is otherwise compatible with the overall product composition and, therefor, within the principles of this invention. Thus, it is not essential that a plastisol always be used. Organosols and aqueous latices (aquasols and hydrosols) are also of use, employing as the dispersing or suspending media, organic solvents and water, respectively, rather than plasticizers, as in the case of a plastisol.

Where the preferred plastisol is employed, typical of the the plasticizers which can be used are dibutyl sebacate, butyl benzyl sebacate, dibenzyl sebacate, dioctyl adipate, didecyl adipate, dibutyl phthalate dioctyl phthalate dibutoxy ethyl phthalate butyl benzyl phthalate, dibenzyl phthalate di(2-ethylhexyl) phthalate alkyl or aryl modified phthalate esters, alkyl, aryl, or alkylaryl hydrocarbons, tricresyl phosphate, octyl diphenyl phosphate, dipropylene glycol dibenzoate, dibasic acid glycol esters, and the like. Other constituents of the resinous substrate coating can include a blowing or foaming agent such as azodicarbonamide (if a blowing or foaming procedure is desired), conventional stabilizers/accelerators, initiators, catalysts, etc., such as zinc oleate, dibasic lead phosphite, etc., conventional heat or light stabilizers, such as metallic soaps, etc., UV absorbers, colorants, dyes or pigments, notably, titanium oxide, solvents and diluents, such as methyl ethyl ketone, methyl isobutyl ketone, dodecyl benzene, etc., fillers, such as clay, limestone, etc, viscosity modifiers, antioxidants, bacteriostats and bacteriocides and the like.

Print Layer

Suitable inks include those normally used in the manufacture of floor covering, preferably resilient floor covering. These include plastisol, solvent based systems and water based systems. Such systems can include a chemical suppressant in those cases where the substrate to which the ink is to be applied is a foamable plastisol or organosol. Such suppressants are well known in the art (e.g. see U.S. Pat. No. 3,293,094).

Printing onto the substrate can be effected by rotogravure, flexigraphic, screen printing, or other printing techniques conventionally employed in making floor or wall covering products.

Adhesive Layer

The adhesive layer is normally a plastisol or organosol containing a plasticizer system, associated diluents, viscosity control aids and stabilizers. Those discussed above are exemplary. When underprinting is present, the adhesive would not normally contain colors or pigments which would render the adhesive layer opaque.

Although other homopolymers and copolymers of vinyl chloride, (i.e. vinyl resins other than a plastisol or organosol) such as those discussed above, can also be employed, as a practical matter, current economics dictate the use of polyvinyl chloride plastisols of the type set forth in the examples hereinafter.

Resinous Particles

The resinous particles of this invention can be of various sizes and geometric shapes, spherical and essentially spherical, (sometimes referred to herein as "spheroidal") being especially preferred as having the low aspect ratios discussed herin required to obtain the desirable design effects this invention is capable of providing. Each transluscent or opaque particle can contain its own individual colorant, dye or pigment, provided that in some embodiments of this invention at least some of the particles must be sufficiently transparent or sufficiently transluscent, to permit the printing on the print layer to show through.

Although decorative chips and flakes, such as those disclosed in U.S. Pat. No. 4,212,691, can be employed, it is preferred to employ discreet spheroidal particles for enhanced visual effect of depth and improved wear characteristics. Illustrative of those spheroidal particles which are especially preferred are the particles and the methods for their manufacture taught in U.S. Pat. No. 3,856,900. This procedure is particularly convenient for the production of relatively small plastisol beads or "pearls" having a particle size of generally about 0.030 inch or smaller.

For smaller particles and those ranging up to about 0.04 inch, these can be obtained by screening the oversized particles from normal suspension grade resin production or by making special particle sizes, for example, in accordance with U.S. Pat. No. 3,856,900. Particles in this size range are particularly useful for achieving certain desirable design effects. Such procedures are also capable of making smaller particle sizes, for example, ranging from about 0.0015 inch to about 0.0125 inch, (e.g. see U.S. Pat. No. 3,345,235), but in the case of spheroidal particles, the procedure of U.S. Pat. No. 3,856,900 is preferred.

It has been found that the size of the particles employed in carrying out this invention have a pronounced effect on the results obtained. Use of relatively small particles, e.g. ranging from about 150 microns (100 mesh) to about 600 microns (30 mesh) are most advantageous in producing the desired design effects. Particles, especially spheroidal particles, averaging about 600 microns (by microscopic observation) are especially preferred.

The ratio of transparent to colored particles determines the visibility of the printed pattern underneath the resulting adhesive matrix. Generally, 50% or less, and preferably 0–30%, transparent to colored particle loading is preferred. The amount actually used will, of course, depend upon the type of end-use application and design effect desired. Good results have even been achieved in the range of 0–10% transparent to colored particle loading.

Wearlayer

The optional overcoat or wearlayer is preferably a plastisol of the same or similar type as that discussed above in connection with the resins employed in the substrate coat and the adhesive layer or matrix. The formulations generally include materials to enhance special specific properties, for example gloss, wear, stain resistance, and scuff resistance.

Other resins suitable for use as a top coating can be employed. Exemplary are wear resistant polyurethanes, such as those described in U.S. Pat. No. 4,087,400.

Thus in another embodiment of this invention the decorative, inlaid floor or wall coverings comprise:

(a) a flexible mat substrate, (b) a gelled, resinous print layer, applied over said substrate, the surface of which is printed with one or more inks suitable for use in the manufacture of floor or wall covering products, and (c) an adhesive matrix, overlaying said print layer, containing an effective amount of a homopolymer or a copolymer of vinyl chloride, and in which are embedded resinous particles, at least some of which permit the underprint to show through, and (d) an optional topcoating or wearlayer or wearlayers selected from the group consisting of a plastisol, a polyurethane resin or a suitable mixture of each.

The following examples are intended to demonstrate preferred embodiments of this invention without limiting the scope thereof. In the following examples all parts and percentages are by weight.

EXAMPLE 1

Floor Covering with Overall Pattern Suitable for Commercial Uses

A floor covering substrate sheet of conventional type non-asbestos felt (Tarkett Inc., Whitehall, Pa.), approximately 32 mils thick, was bar coated (wire wound bar) with approximately 3 mils of a layer of white printable plastisol, the composition of which was as follows:

| | Parts by Weight |
|---|---|
| PVC emulsion: relative viscosity 2.05 (Occidental FPC 605) | 70 |
| PVC extender: k value 60 PLIOVIC M-50) | 30 |
| Di(2-ethylhexyl) phthalate | 30 |
| Butyl benzyl phthalate | 30 |
| Titanium dioxide | 5 |
| Crystalline calcium carbonate | 80 |
| Barium-zinc type stabilizer (IRGASTAB BZ 530) | 3 |

After gelling against a heated chromium drum at 300° F., the resulting smooth surface is gravure printed on a flat print press using solvent based inks of the following composition:

| | Parts by Weight |
|---|---|
| PVC—polyvinyl acetate copolymer | 100 |
| Pigments (A purchased blend of colors selected from red oxide, yellow oxide, chrome yellow, molybdate orange, carbon black, titanium dioxide, quinanthrone red, phthallo blue and phthallo green.) | 180 |
| Solvent (Methyl ethyl ketone/xylene) | 600 |
| Dispersion aid | 2 |

After drying in warm air at about 140° F., an adhesive layer about 10 mils thick was applied by drawdown bar and an excess of premixed plastisol pearls (produced in Example 3 and having the composition set forth hereinafter, about half of which were transparent and the remainder colored, were evenly distributed on the surface of the wet, tacky adhesive layer from a vibrating pan (SYNTRON vibrator manufactured by FMC Corp.). The composition of the adhesive mix was:

| | Parts by Weight |
|---|---|
| PVC emulsion: relative viscosity 2.05 (Occidental FPC 6458) | 70 |
| PVC extender: k value 60 PLIOVIC M-50) | 30 |
| Butyl benzyl phthlate | 25 |
| Di-isononyl phthlate | 25 |
| Stabilizer, barium-zinc type (SYNPRON 1665) | 4 |

The composition of the pearl particles was:

| Parts by Weight | Colored | Transparent |
|---|---|---|
| Suspension grade PVC resin: k value 65 (PEVIKON S658 GK) | 100 | 100 |
| Butyl benzyl phthalate | 40 | 40 |
| Stabilizer, barium-zinc type (SYNPRON 1665) | 4 | 4 |
| Titanium dioxide | 5 | — |
| Color-pigment | 5 | — |

(Purchased blend of red iron oxide, yellow iron oxide and carbon black dispersed in di(2-ethyl-hexyl) phthalate)

The PEVIKON S658 GK resin had an aspect ratio of about 1 (the particles were round) and the particle size was found by microscopic observation to average about 600 microns (approximately 30 mesh). Screen analysis was as follows:

| Mesh | % Retained |
|---|---|
| 28 (589 microns) | 68.0 |
| 65 (208 microns) | 25.2 |
| 100 (147 microns) | 1.4 |
| Thru 100 mesh | 5.4 |

The excess pearls, which were not wetted by the adhesive coating and embedded therein were blown away by a gentle air stream. The resultant grainy matrix was then gelled by contacting the coated side against a heated chromium drum (350° F.) and smoothed between a rubber pressure roller and the drum surface. The thickness of the matrix containing the adhesive coat (10 mils) and the embedded pearls (approximately 20 mils) was 30 mils.

The surface of the matrix was then bar coated using a drawdown bar with a transparent plastisol wearlayer having the following composition:

| | Parts by Weight |
|---|---|
| Dispersion grade PVC, relative viscosity 2.05 (Occidental FPC 6458) | 100 |
| Isobutyric acid and glycol ester of benzoic acid (Monsanto SANITIZER S-377 plasticizer) | 56 |
| Stabilizer, barium-zinc type (SYNPRON 1665) | 5 |
| Epoxidized soybean oil | 5 |
| Kerosene | 2 |

Brookfield Viscosity: ~1200 cps

The wearlayer was fused in a hot air oven at about 380° F. for 3.5 minutes and then embossed between a cooled embossing roll and a rubber pressure roll. The resultant wearlayer has a thickness of about 15 mils.

The wear characteristics of the decorative inlaid product thereby produced are set forth in the following Table I and compared with leading competitive products.

TABLE I

TABER ABRASION
Run on Taber Abrasion Model #505 using H-18 wheels

| PRODUCT | Initial Wt 4" × 4" Smpl (g) | Caliper (mils) | Wt. Loss % 1000 cycles (g) | Wear-out Point (cycles) | Product Thickness to Wear-out Point (mils) |
|---|---|---|---|---|---|
| TARKETT | | | | | |
| Residential | 21.3014 | 92 | .0803 | 36,000 | 36 |
| Commercial | 22.3489 | 83 | .0919 | 60,500 | 45 |
| ARMSTRONG | | | | | |
| "Crowne Corlon" | 26.0910 | 75 | .2294 | 22,500 | 42 |
| "Designer Solarian" | 28.2392 | 88 | .2696 | 27,500 | 60.5 |
| "Solarian Supreme II" | 28.7303 | 92 | .3131 | 3,000 | 5 |
| CONGOLEUM "Innovation" | 17.2543 | 72 | .0905 | 8,000 | 10 |
| FORBO "Smaragd" | 18.1629 | 56 | .0416 | 24,000 | 27 |

EXAMPLE 2

Residential Floorcovering with Registered Printed and Embossed Patterns (Chemically Embossed)

A floorcovering substrate sheet of conventional type non-asbestos felt (Tarkett Inc., Whitehall, Pa.) approximately 32 mils thick was coated with a foamable plastisol the composition of which was as follows:

| | Parts by Weight |
|---|---|
| PVC dispersion: k value 65 (Occidental FPC 605) | 70 |
| PVC extender resin: k value 60 (PLIOVIC M-50) | 30 |
| Di(2-ethylhexyl) phthlate | 28 |
| Butyl benzyl phthlate | 15 |
| Texanol isobutyrate (TXIB) | 15 |
| Titanium dioxide | 10 |
| Azodicarbonamide | 2.5 |
| Kerosene | 4 |

-continued

| | Parts by Weight |
|---|---|
| Zinc oxide | 1.5 |

Viscosity: 2500 cps

The coated substrate is then pregelled in a hot oven at 275° F. for 2.5 minutes. The surface is then gravure printed on a flat bed press using solvent based PVC-polyvinyl acetate copolymer inks having the same composition as those of Example 1 except that the inks used to cover the plate printing the valley areas of the pattern (i.e. the grouts) contain additionally 140 parts benzotriazole, a chemical suppressant, to inhibit in these selected areas the expansion of the foamable plastisol.

After drying the print, an adhesive layer having the same composition as that of Example 1 was applied by a drawdown bar. Premixed colored and transparent pearls, in the same ratio as those of Example 1 and prepared by the procedure of Example 3, were evenly distributed, gelled and smoothed as described in Example 1. The thickness of the resulting matrix containing the pearls (15 mils) embedded in the adhesive (5 mils) was about 20 mils. Approximately 10 mils of a transparent wearlayer having the same composition as that of Example 1 was applied with a drawdown bar. The resulting product was then fused and expanded (i.e. foamed) in a hot air oven at 380° F. for 3 minutes.

The floorcovering produced shows a relief structure (embossing) in register with the printed areas. The decorative inlaid product thereby produced has an overall thickness of about 82 mils and exhibited excellent wear and design characteristics.

EXAMPLE 3

The plastisol spherical "pearls" used in the foregoing examples were prepared using the following formulations:

| Parts by Weight | Colored | Transparent |
|---|---|---|
| Suspension grade PVC resin, coarse: k value 65 (PEVICON S658 GK) | 100 | 100 |
| Butyl benzyl phthalate | 40 | 40 |
| Barium-zinc stabilizer (SYNPRON 1665) | 4 | 4 |
| Titanium dioxide | 5 | — |
| Color-pigment | 5 | — |

In preparing the colored and transparent plastisol composition, the PVC resin (at 70° F.) was charged to a high intensity mixer running at 3500 RPM and mixed until the batch temperature reached 160° F. (about 10 minutes). The speed of the mixer was then reduced to 500 revolutions per minute and the pigment pastes, plasticizer and stabilizer were added slowly over a period of about 5 minutes. The speed was then increased to 2000–3000 rpm and the material mixed until the batch temperature reached 260° F. (approximately 15 minutes additional). The speed was then reduced to 500 RPM and the material was mixed until the batch temperature cooled to 70°–90° F. (about 30 additional minutes).

The pearls produced were essentially spherical, dry and free running; did not exceed 0.060 inch in diameter, and had a particle size distribution range of 0.004 to 0.040.

The following table summarizes the process parameters employed:

| Elapsed Time Min. | Temperature Degrees F. | Speed Rev/Min |
|---|---|---|
| 0 | ~70 | 3500 |
| 10 | 160 | 500 pigments, plasticizer and stabilizer added |
| 15 | 260 | 2000–3000 |
| 30 | | 500 cooling |
| 60 | ~70 | — |

Equipment: High intensity mixer 2.6 gal. volume 3 lbs. loading

Examples 1 and 2 demonstrate decorative, inlaid floor coverings which constitute highly preferred embodiments of this invention and which comprise:

(a) a substrate sheet of conventional type non-asbestos felt, (b) a gelled, thin, white, or tinted, printable plastisol coating over said substrate, prepared from effective amounts of a formulation comprising:
- an emulsion type PVC, preferably having a relative viscosity about 2.5,
- a PVC extender, preferably having a k value about 60,
- a plasticizer, preferably a phthlate such as di(2-ethylhexyl) phthlate or butyl benzyl phthalate,
- a pigment, preferably titanium dioxide,
- crystalline calcium carbonate, and
- a barium-zinc type stabilizer (c) a print layer of one or more inks made from effective amounts of a formulation comprising:
- a PVC-PCAc resin copolymer,
- one or more pigments,
- a solvent, preferably consisting essentially of methyl ethyl ketone and xylene, and
- a dispersion aid;

(d) a gelled adhesive layer made from effective amounts of a formulation comprising:
- a PVC dispersion, preferably having a relative viscosity about 2.5,
- a PVC extender, preferably having a k value about 60,
- a plasticizer, preferably butyl benzyl phthalate or di-isononyl phthalate, and
- a barium-zinc type stabilizer, and (e) a mixture of gelled, transparent and colored pearls, wherein the pearls are about 50% transparent and about 50% colored, evenly distributed on the adhesive layer, prepared from effective amounts of a formulation comprising:
- a PVC suspension resin, preferably coarse and having a k value about 65,
- a plasticizer, preferably butyl benzyl phthalate,
- a barium-zinc stabilizer, and, optionally,
- a pigment or a color selected from the group consisting of red iron oxide, yellow iron oxide, chrome yellow, molybdate orange, carbon black, titanium oxide, quinanthrone red, phthallo blue and phthallo green.

Although the forgoing discussion describes this invention in terms of floor or wall covering products, this invention is intended to encompass any covering including, but not necessarily limited to, floor or wall covering, which incorporates a matrix layer of discreet, low aspect ratio resinous particles embedded in a resinous coating.

While the invention has been described with respect to certain embodiments thereof, it will be apparent to those skilled in the art that various changes and modifications may be made without departing from the spirit and scope of the invention.

What is claimed is:

1. A decorative, inlaid floor or wall covering which comprises:

(a) a substrate, (b) a printed layer applied over said substrate in the form of a pattern, and (c) an adhesive matrix layer, overlaying said printed layer, consisting essentially of an adhesive in which is embedded spherical or essentially spherical particles having an aspect ratio no greater than about 2:1 wherein said pattern is visible through said adhesive matrix layer.

2. The product of claim 1 wherein the substrate is a flexible mat.

3. The product of claim 1 wherein the substrate is a non-asbestos felt sheet.

4. The product of claim 1 wherein the printed layer is a gelled, resinous layer, the surface of which has been printed with an ink suitable for use in the manufacture of floor or wall covering products.

5. The product of claim 1 wherein the adhesive contains as a major component a homopolymer or copolymer of vinyl chloride.

6. The product of claim 5 wherein the spherical or essentially spherical resinous particles are a blend or pigmented and transparent particles.

7. The product of claim 6 wherein said resinous particles are plasticized polyvinyl chloride particles having an aspect ratio no greater than about 1.5:1.

8. The product of claim 1 wherein the adhesive matrix layer is applied only in selected areas to give a pattern.

9. The product of claim 1 wherein the spherical or essentially spherical resinous particles are a blend of pigmented and transparent particles.

10. The product of claim 9 wherein said resinous particles are essentially spherical, plasticized polyvinyl chloride particles having an aspect ratio no greater than about 1.5:1.

11. The product of claim 9 wherein said pigmented particles are selected from the group consisting of translucent and opaque particles.

12. A decorative, inlaid floor or wall covering which comprises:

(a) a flexible mat substrate, (b) a gelled, resinous printed layer, overlaying said substrate, the surface of which is printed in the form of a pattern with one or more inks suitable for use in the manufacture of floor or wall covering products, and (c) an adhesive matrix layer, overlaying said printed layer, consisting essentially of an adhesive in which is embedded spherical or essentially spherical resinous particles having an aspect ratio no greater than about 2:1, wherein the adhesive contains a homopolymer or a copolymer of vinyl chloride, and wherein said pattern is visible through said adhesive matrix layer.

13. The product of claim 12 wherein the particles are a blend of transparent particles, and pigmented particles which are selected from the group consisting of translucent and opaque particles.

14. The product of claim 12 wherein said particles are plasticized polyvinyl chloride particles.

15. The product of claim 12 wherein the substrate is a non-asbestos felt sheet.

16. The product of claim 12 wherein the resinous printed layer is a gelled, foamed or foamable layer and at least one of the inks is a suppressant ink.

17. The product of claim 12 wherein the adhesive matrix layer is applied in selected areas to give a pattern.

18. The product of claim 12 wherein the particles are discreet, spherical or essentially spherical vinyl chloride, homopolymer or copolymer polymerization agglomerates, sized between about 0.004–0.040 inches.

19. The product of claim 12 wherein the adhesive matrix layer is coated with at least one wearlayer.

20. A decorative, inlaid floor covering which comprises:

(a) a non-asbestos felt sheet substrate, (b) a gelled, printable, plastisol coating over said substrate, (c) a printed layer comprised of one or more solvent based polyvinyl chloride/polyvinyl acetate inks applied to the surface of the plastisol layer in the form of a pattern, (d) a gelled adhesive matrix layer, overlaying said printed layer, consisting essentially of an adhesive in which is embedded spherical or essentially spherical, gelled resinous particles having an aspect ratio no greater than about 2:1, wherein said adhesive contains a homopolymer or a copolymer of vinyl chloride and said particles are polyvinyl chloride homopolymer or copolymer polymerization agglomerates, sized between about 0.004–0.040 inches, and wherein said pattern is visible through said adhesive matrix layer, and (e) a fused, transparent, plastisol wearlayer as a topcoat.

21. The product of claim 20 wherein the inks are made from a formulation comprising:

(a) a polyvinyl chloride - polyvinyl acetate copolymer resin, (b) one or more pigments, (c) one or more solvents, and (d) a dispersion aid.

22. The product of claim 21 wherein said formulation additionally comprises benzotriazole and wherein the plastisol is foamable.

23. The product of claim 20 wherein the resinous particles are a blend of pigmented and transparent particles which are essentially evenly distributed within the adhesive matrix layer.

24. The product of claim 20 wherein the printable plastisol coating is applied using a wire wound bar and is gelled against a heated chromium drum at about 300 degrees F.; the inks are applied to the surface of the printable plastisol coating by gravure printing using a flat print machine; the adhesive is applied using a drawdown bar; the spherical or essentially spherical particles are applied to the adhesive while it is still wet using a vibrating device wherein the amplitude determines the flow rate of the particles, and the resultant intermediate is gelled in contact with a heated chromium drum, thereby embedding the particles into the adhesive, and smoothed between a rubber pressure roller and the drum surface at about 300 degrees F.

25. The product of claim 20 wherein the printable plastisol coating is a foamable plastisol, pregelled in a hot air oven at about 275 degrees F. for about 2.5 minutes, the surface of which is then printed using at least one solvent based polyvinyl chloride/polyvinyl acetate ink containing a chemical suppressant to locally inhibit the expansion of the foamable plastisol in preselected areas, and wherein the product is fused and foamed in a hot air oven at about 380 degrees F. for about 3 minutes to form an embossed pattern.

26. In a decorative, inlaid floor or wall covering comprising a substrate and a printed layer applied over said substrate in the form of a pattern, the improvement which comprises an adhesive matrix layer applied over said printed layer which consists essentially of spherical or essentially spherical resinous particles having an aspect ratio no greater than about 2:1 embedded in an adhesive, wherein said pattern is visible through said adhesive matrix layer.

27. The product of claim 26 further comprising at least one wearlayer applied over said adhesive matrix layer.

28. A decorative, inlaid floor covering which comprises:

(a) a substrate, (b) a foamed layer overlaying the substrate, the surface of which is printed in the form of a pattern, and (c) an adhesive matrix layer, overlaying the printed foamed layer, consisting essentially of an adhesive in which is embedded spherical or essentially spherical resinous particles having an aspect ratio no greater than about 2:1, wherein said pattern is visible through said adhesive matrix layer.

29. The product of claim 28 further comprising at least one wearlayer applied over said adhesive matrix layer.

* * * * *

UNITED STATES PATENT AND TRADEMARK OFFICE

CERTIFICATE OF CORRECTION

PATENT NO. : 5,015,516

DATED : May 14, 1991

INVENTOR(S) : Edward F. Lussi et al.

It is certified that error appears in the above-identified patent and that said Letters Patent is hereby corrected as shown below:

Title page at [75] "Bethelem" should read -- Bethlehem --; at [57], line 8, "no" should read -- do --.

Column 6, lines 7 and 13, correct the spelling of "synthetic"; line 29, after "phthalate" insert a comma; line 30, after "phthalate" insert a comma in two places; line 31, after "phthalate" insert a comma.

Column 7, line 15, correct the spelling of "herein"; lines 17 and 21, correct the spelling of "translucent".

Column 9, line 1, after "after" delete the comma and insert -- ) --; line 9, "emulsion" should read -- dispersion --; lines 13 and 14 correct the spelling of "phthalate".

Column 10, lines 64 and 65, correct the spelling of "phthalate".

UNITED STATES PATENT AND TRADEMARK OFFICE

CERTIFICATE OF CORRECTION

PATENT NO. : 5,015,516

DATED : May 14, 1991

INVENTOR(S) : Edward F. Lussi et al

It is certified that error appears in the above-identified patent and that said Letters Patent is hereby corrected as shown below:

Column 12, line 25, correct the spelling of "phthalate(1st occurence)" line 31, "PCAc" should read -- PVAc --.

Column 13, line 11, after "spherical" insert -- resinous --.

Column 13, line 28, after "blend", "or" should read -- of --.

Signed and Sealed this

First Day of December, 1992

*Attest:*

*Attesting Officer*

DOUGLAS B. COMER

*Acting Commissioner of Patents and Trademarks*